US005743774A

United States Patent [19]

Adachi et al.

[11] Patent Number: 5,743,774

[45] Date of Patent: Apr. 28, 1998

[54] EXHAUST STRUCTURE OF OUTBOARD MOTOR

[75] Inventors: Shigeo Adachi, Hamamatsu; Masaaki Yoshimura, Shizuoka-ken, both of Japan

[73] Assignee: Suzuki Kabushiki Kaisha, Japan

[21] Appl. No.: 690,991

[22] Filed: Aug. 1, 1996

[30] Foreign Application Priority Data

Aug. 8, 1995 [JP] Japan ..... 7-202557

[51] Int. Cl.[6] ..... B63H 20/24

[52] U.S. Cl. ..... 440/89; 60/295; 60/299

[58] Field of Search ..... 440/89; 60/295, 60/299, 302, 296

[56] References Cited

U.S. PATENT DOCUMENTS 5,306,185 4/1994 Lassanske et al. ..... 60/296

5,346,417 9/1994 Isogawa ..... 440/89

5,372,530 12/1994 Holtermann et al. ..... 440/89

5,494,467 2/1996 Sohgawa et al. ..... 440/89

*Primary Examiner*—Sherman Basinger

*Attorney, Agent, or Firm*—Ronald P. Kananen

[57] ABSTRACT

An outboard motor is provided with an engine holder, an engine mounted to an upper portion of the engine holder, a drive shaft housing mounted to a lower portion of the engine holder and an exhaust structure connecting an exhaust inlet opening formed to an upper surface of the engine holder to an exhaust outlet opening formed to a lower surface of the engine holder, in an installed state. The exhaust structure has an exhaust port passage extending downward from the engine and communicated with the exhaust inlet opening, an exhaust tube extending downward into the drive shaft housing and an exhaust passage formed between the exhaust inlet and outlet openings, the exhaust passage extending horizontally in the engine holder and being formed with a catalyst chamber in which a catalyst is arranged horizontally.

5 Claims, 4 Drawing Sheets

EXHAUST STRUCTURE OF OUTBOARD MOTOR

BACKGROUND OF THE INVENTION

The present invention relates to an exhaust structure of an outboard motor having an exhaust catalyst means in an arrangement hardly contacting water such as sea water.

In a recent structure of an outboard motor unit, a catalyst means is disposed on the way of an exhaust passage for preventing contamination to atmosphere or water due to an exhaust gas from the outboard motor.

FIG. 5, which is described hereinlater, is a partial sectional view of an outboard motor having a general structure, and referring to FIG. 5, an outboard motor 1 has an engine 3 mounted to an upper portion of an engine holder 2 covered by an engine cover 4, and a drive shaft housing 5 is also arranged at a lower portion of the engine holder 2. A gear case 6 is mounted to a lower portion of the drive shaft housing 5.

An exhaust pipe 7 extends downward from the engine 3 and the exhaust pipe 7 has a downstream side end to which an exhaust tube 8 is connected. The exhaust tube 8 extends downward in the drive shaft housing 5, and an exhaust gas from the engine 3 passes through the drive shaft housing 5 and the gear case 6 and is discharged into water through an exhaust passage 9*a* formed around a propeller shaft 9.

In the above arrangement, a catalyst means 10 for cleaning the exhaust gas is disposed at a connection portion between the exhaust pipe 7 and the exhaust tube 8, for example.

However, in the case where the catalyst means is disposed in the exhaust pipe extending downward from the engine, the catalyst is likely contacted to the water in the drive shaft housing, thus degrading or damaging the performance of the catalyst. Furthermore, in the described arrangement, when it is required to exchange the catalyst with a new one at a time of maintenance or inspection, it is required to disassemble the engine for the exchanging of the catalyst, thus being troublesome and involving much time and labour.

SUMMARY OF THE INVENTION

An object of the present invention is to substantially eliminate defects or drawbacks encountered in the. prior art described above and to provide an exhaust structure of an outboard motor having an exhaust catalyst means capable of preventing the catalyst from contacting water such as sea water.

Another object of the present invention is to provide an exhaust structure of an outboard motor having a catalyst means and a structure easily attached to or detached from the outboard motor.

These and other objects can be achieved according to the present invention by providing an exhaust structure of an outboard motor having an engine holder, an engine mounted to an upper portion of the engine holder, a drive shaft housing mounted to a lower portion of the engine holder and an exhaust structure connecting an exhaust inlet opening formed to an upper surface of the engine holder to an exhaust outlet opening formed to a lower surface of the engine holder, in an installed state, the exhaust structure comprising an exhaust port passage extending downward from the engine and communicated with the exhaust inlet opening, an exhaust tube extending downward into the drive shaft housing and an exhaust passage formed between the exhaust inlet and outlet openings, the exhaust passage extending horizontally in the engine holder and being provided with a catalyst horizontally arranged on the way of the exhaust passage. The catalyst may be disposed in a catalyst chamber formed on the way of the exhaust passage.

In a preferred embodiment, the exhaust port passage has an opening in alignment with the exhaust inlet opening and the exhaust tube has an opening in alignment with the exhaust outlet opening. A water jacket is arranged around the opening of the exhaust tube, the opening of the exhaust port passage and the exhaust passage.

Exhaust passage covers for covering the exhaust passage are detachably mounted to both side portions of the engine holder. The exhaust passage covers are arranged so as to divide a portion of the exhaust passage.

According to the present invention of the structure described above, since the exhaust passage is formed horizontally in the engine holder and the catalyst is disposed on the way of the exhaust passage, the water in the drive shaft housing hardly splashes on the catalyst. Thus, the possibility of lowering or damaging the function of the catalyst can be substantially eliminated. Furthermore, since the water jacket is formed around the exhaust passage, the temperature of the catalyst can be stably maintained, thus preventing the cleaning performance for the exhaust gas from degrading.

Still furthermore, since the exhaust passage covers are detachably mounted to both the side portions of the engine holder to partially divide the exhaust passage, the catalyst can be easily exchanged merely by dismounting the exhaust passage covers in comparison with a conventional structure in which the engine must be dismounted to exchange the catalyst, thus being effective in operation and maintenance.

The nature and further features of the present invention will be made more clear from the following descriptions made with reference to the accompanying drawings.

DESCRIPTION OF THE PREFERRED EMBODIMENT

Figure 1:
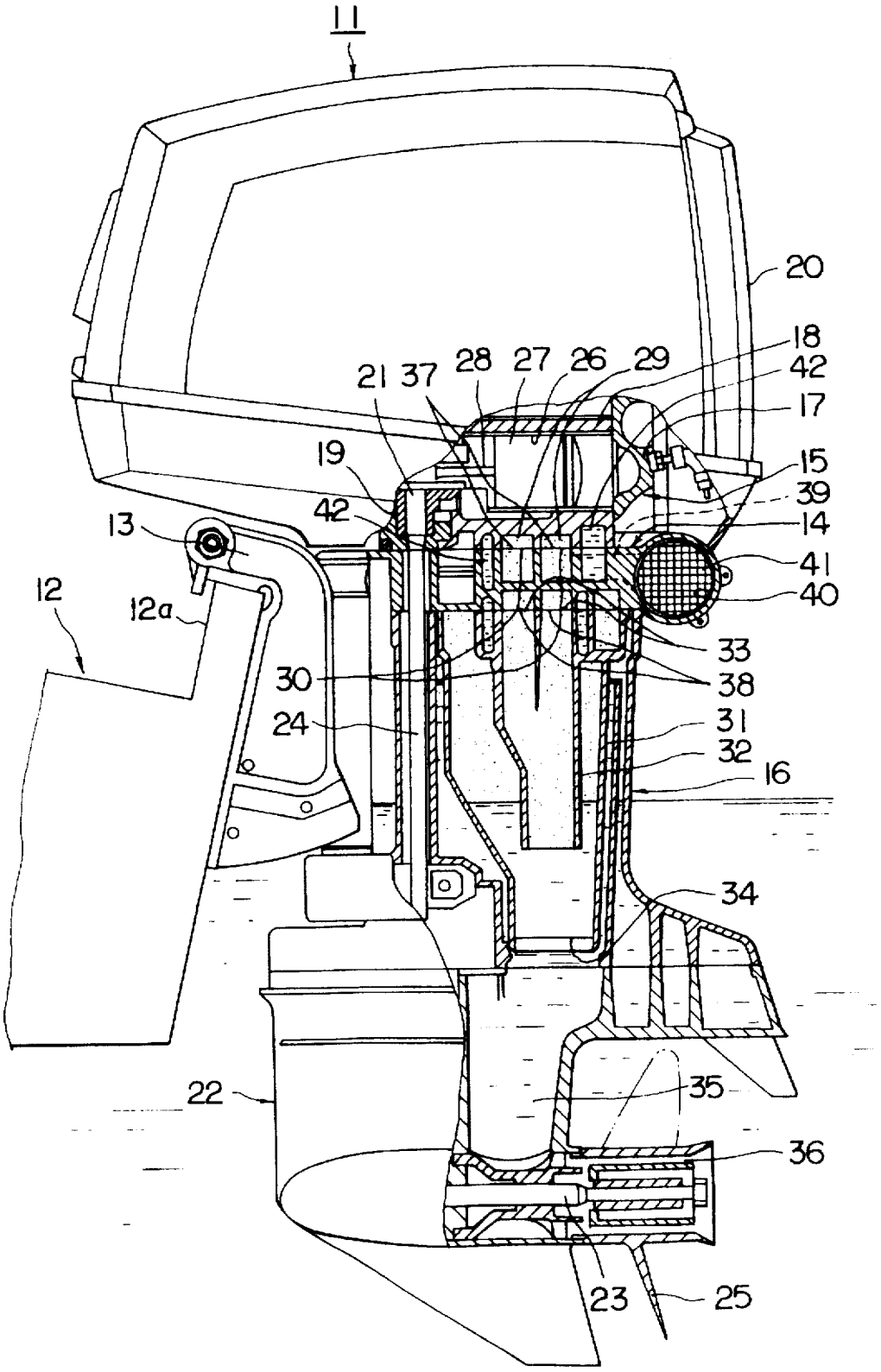
FIG. 1 is an elevational section of an outboard motor unit provided with an exhaust structure having a catalyst means according to one embodiment of the present invention.

Referring to FIG. 1, showing one embodiment of the present invention, an outboard motor unit 11 is mounted to a transom 12*a* of a hull 12 through a bracket 13, and the outboard motor unit 11 is provided with an engine holder 14 connected to the bracket 13. An engine 15 is mounted to an upper portion of the engine holder 14 and a drive shaft housing 16 is mounted to a lower portion of the engine holder 14, respectively.

The engine 15 is assembled, for example, with a cylinder head 17, a cylinder block 18 and a crank case 19 and covered by an engine cover 20. A crank shaft 21 is supported to be rotatable in the crank case 19.

A gear case 22 is mounted to the lower portion of the drive shaft housing 16 and a propeller shaft 23 driven by the engine 15 is supported to be rotatable to the gear case 22, and the rotation of the engine 15 is transmitted to the propeller shaft 23 through a drive shaft 24 connected to the crank shaft 21 and a bevel gear, not shown, to thereby drive a propeller 25 supported to the rear end of the propeller shaft 23.

A cylinder 26 is arranged in the cylinder block 18 of the engine 15. A piston 27 is inserted into the cylinder 26 to be slidable therein, and the piston 27 and the crank shaft 21 are connected through a connection rod 28 to convert the reciprocating stroke of the piston 27 to the rotational motion of the crank shaft 21. The cylinder block 18 is formed with an exhaust port extending downward and communicated with the inside of the cylinder 26, and the exhaust port 29 is provided with an opening opened upward to the upper surface of the engine holder 14.

An exhaust expansion chamber 31 having a cylindrical shape is formed inside the drive shaft housing 16 in a vertical fashion in an installed state so that the upstream side end portion has a level substantially coincident with the upper surface of the drive shaft housing 16. Within the exhaust expansion chamber 31, there is arranged a cylindrical exhaust tube 32 in a vertical fashion so that the upstream side end portion of the tube 32 also has a level substantially coincident with the upper surface of the drive shaft housing 16. The exhaust tube 32 has an opening 33 opened toward the lower surface of the engine holder 14.

Further, the cylindrical exhaust expansion chamber 31 also has an opening 34 opened on the downstream side of the drive shaft housing 16, and the opening 34 is communicated with an exhaust passage 35 formed in the gear case 22. The exhaust passage 35 is communicated with water through an exhaust gas discharge passage 36 formed around the propeller shaft 23.

Figure 2:
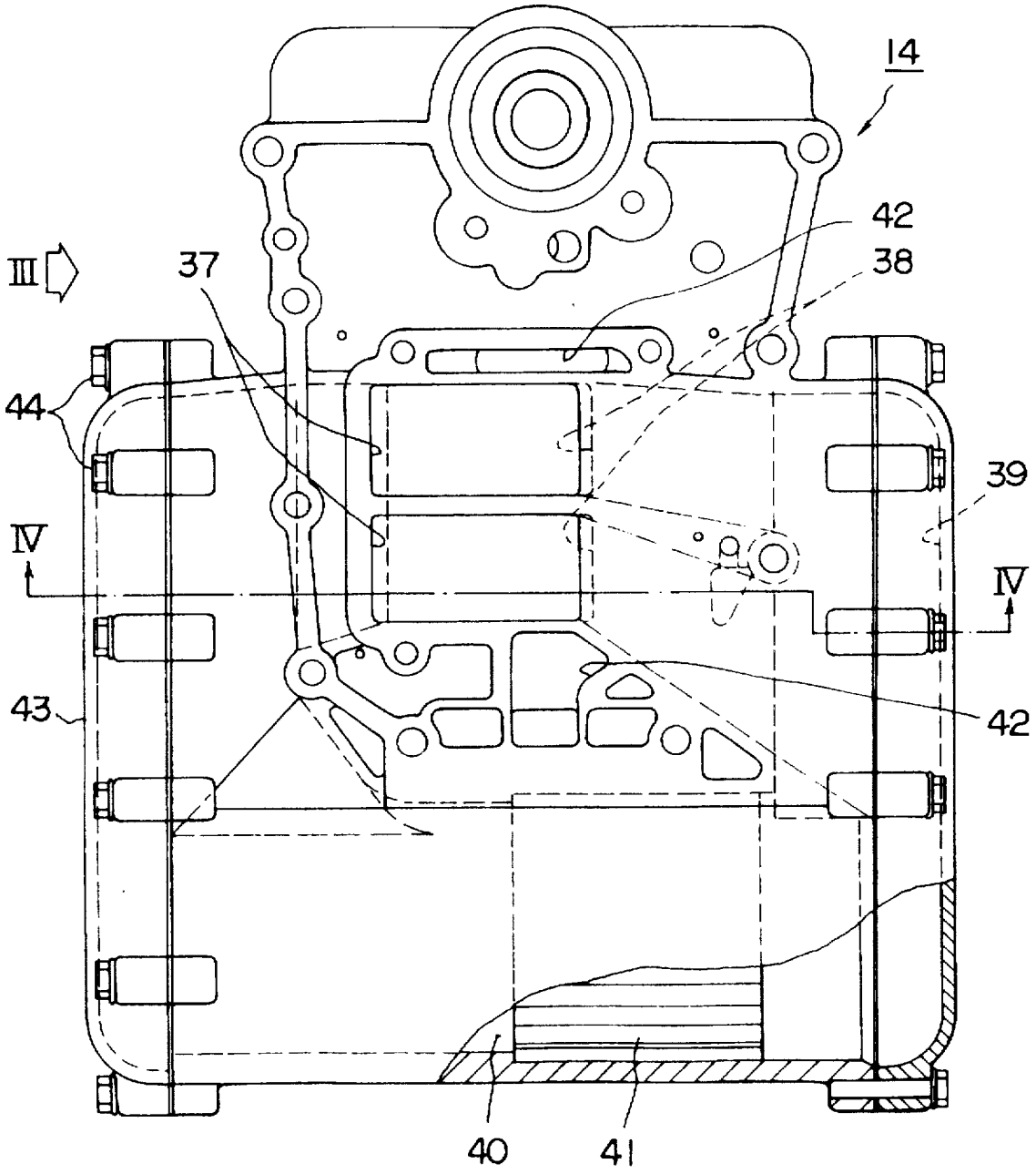
FIG. 2 is a plan view, partially in section, of an engine holder of the outboard motor unit of FIG. 1.
Figure 3:
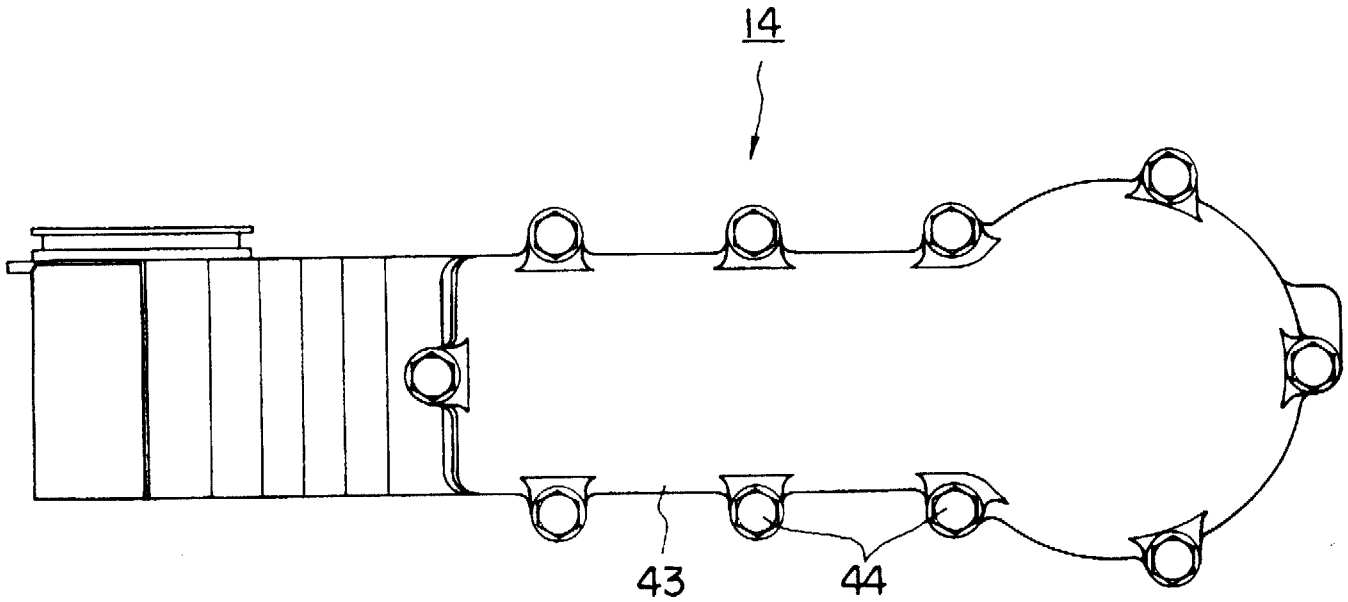
FIG. 3 is a side view shown from an arrowed direction III of FIG. 2.

Referring to FIGS. 1 to 3, inlet openings 37 are formed to the upper surface of the engine holder 14 so that the inlet openings 37 are aligned with openings 30 of the exhaust port 29, and outlet openings 38 are also formed to the lower surface of the engine holder 14 so that the outlet openings 38 are aligned with the openings 33 of the exhaust tube 32. These inlet openings 37 and outlet openings 38 are connected with each other through an exhaust passage 39 formed in the engine holder 14.

The exhaust passage 39 extends in a horizontal direction inside the engine holder 14 and a catalyst chamber 40 is formed on the way of the exhaust chamber 39. A catalyst 41 for cleaning the exhaust gas is disposed in the catalyst chamber 40 horizontally.

A water jacket 42 is formed around the opening 30 of the exhaust port 29, the opening 33 of the exhaust tube 32 and the exhaust passage 39 of the engine holder 14, and cooling water fills in the water jackets 42.

Figure 4:
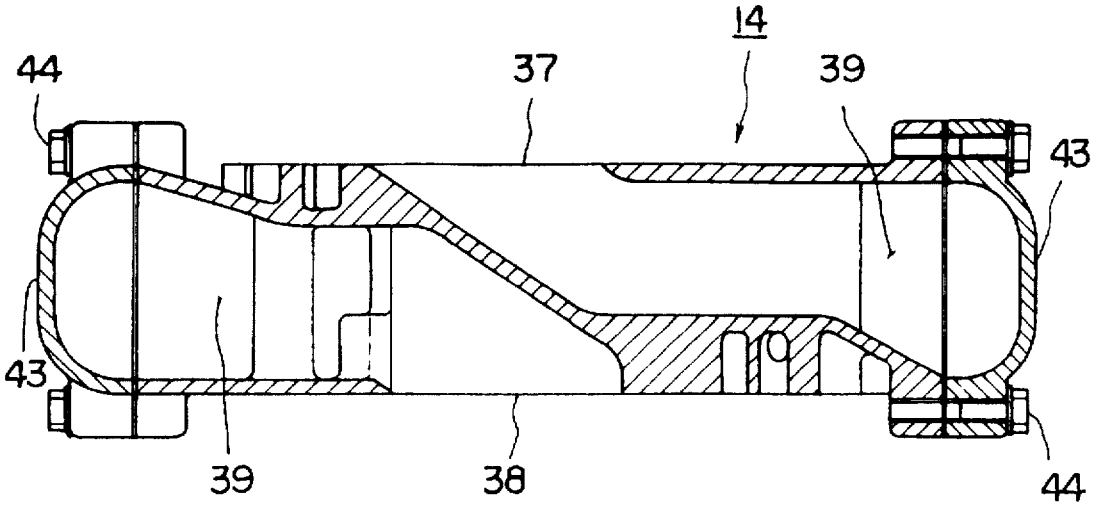
FIG. 4 is a sectional view taken along the line IV—IV in FIG. 2.
Figure 5:
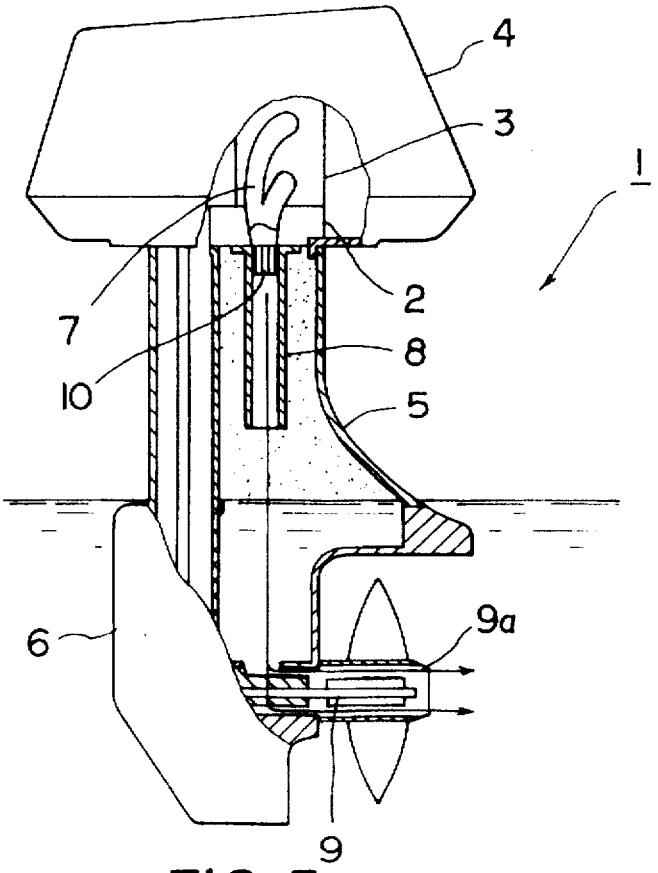
FIG. 5 PRIOR ART
FIG. 5 is a partial sectional view of an outboard motor unit having a conventional structure.

As shown in FIGS. 2 to 4, exhaust passage covers 43 are disposed to both side portions of the engine holder 14 to be detachable and fixed to the engine holder by means of bolts 44 or the like. The exhaust passage covers 43 are constructed so as to partially divide the exhaust passage 39.

The present invention will operates as follows.

The exhaust gas discharged from the exhaust port 29 of the engine 15 flows into the exhaust passage 39 formed in the engine holder 14 through inlet opening 37 formed to the upper surface of the engine holder 14. The exhaust gas entering the exhaust passage 39 contacts the catalyst 41 disposed in the catalyst chamber 40 to clean the exhaust gas. The thus cleaned gas is guided from the outlet opening 38 formed to the lower surface of the engine holder 14 to the exhaust expansion chamber 31 through the exhaust tube 32. In the exhaust expansion chamber 31, the exhaust gas is reduced in pressure and in noise, and thereafter, is guided to the exhaust passage 35 formed to the gear case 22 and then discharged into water through the exhaust gas discharging passage 36 formed around the propeller shaft 23.

According to the present invention of the structure described above, since the exhaust passage 39 is formed horizontally in the engine holder 14 and the catalyst 41 is disposed on the way of the exhaust passage 39, the water in the drive shaft housing 16 hardly splashes on the catalyst 41. Thus, the possibility of lowering or damaging the function of the catalyst 41 can be substantially eliminated. Furthermore, since the water jacket 42 is formed around the exhaust passage 39, the temperature of the catalyst 41 can be stably maintained, thus preventing the cleaning performance for the exhaust gas from degrading.

Still furthermore, since the exhaust passage covers 43 are detachably mounted to both the side portions of the engine holder 14 to partially divide the exhaust passage 39, the catalyst 41 can be easily exchanged merely by dismounting the exhaust passage covers 43 in comparison with a conventional structure in which the engine must be dismounted to exchange the catalyst, thus being effective in operation and maintenance.

What is claimed is:

1. An exhaust structure of an outboard motor having an engine holder, an engine mounted to an upper portion of the engine holder, a drive shaft housing mounted to a lower portion of the engine holder and an exhaust structure connecting an exhaust inlet opening formed to an upper surface of the engine holder to an exhaust outlet opening formed to a lower surface of the engine holder, in an installed state, said exhaust structure comprising an exhaust port passage extending downward from the engine and communicated with the exhaust inlet opening, an exhaust tube extending downward into the drive shaft housing and an exhaust passage formed between said exhaust inlet and outlet openings, said exhaust passage extending horizontally in the engine holder and being provided with a catalyst means which is arranged horizontally on the way of the exhaust passage, wherein exhaust passage covers for covering the exhaust passage are detachably mounted to both side portions of the engine holder.

2. An exhaust structure according to claim 1, wherein said catalyst means is disposed in a catalyst chamber which is formed on the way of the exhaust passage.

3. An exhaust structure according to claim 1, wherein said exhaust port passage has an opening in alignment with the exhaust inlet opening and said exhaust tube has an opening in alignment with the exhaust outlet opening.

4. An exhaust structure according to claim 3, wherein a water jacket is arranged around the opening of the exhaust tube, the opening of the exhaust port passage and the exhaust passage.

5. An exhaust structure according to claim 1, wherein said exhaust passage covers are arranged so as to divide a portion of the exhaust passage.

* * * * *